US006748956B2

(12) United States Patent
Yamashita

(10) Patent No.: US 6,748,956 B2
(45) Date of Patent: Jun. 15, 2004

(54) CIGARETTE FILTER AND CIGARETTE

(76) Inventor: Hiromichi Yamashita, 27-16, Senriyama-nishi 4-chome, Suita-shi, Osaka (JP)

( * ) Notice: Subject to any disclaimer, the term of this patent is extended or adjusted under 35 U.S.C. 154(b) by 0 days.

(21) Appl. No.: 10/143,963

(22) Filed: May 14, 2002

(65) Prior Publication Data

US 2003/0178038 A1 Sep. 25, 2003

(30) Foreign Application Priority Data

Mar. 22, 2002 (JP) ..... 2002-081729

(51) Int. Cl.[7] ..... A24D 3/04

(52) U.S. Cl. ..... 131/335; 131/336; 131/270; 131/331

(58) Field of Search ..... 131/270, 331, 131/335, 336

(56) References Cited

U.S. PATENT DOCUMENTS

| | | | | |
|---|---|---|---|---|
| 2,172,946 A | * | 9/1939 | Sutter | 131/342 |
| 3,319,630 A | * | 5/1967 | Orrmins | 131/344 |
| 4,889,144 A | | 12/1989 | Tateno et al. | |

FOREIGN PATENT DOCUMENTS

| | | |
|---|---|---|
| JP | 58-205490 | 11/1983 |
| JP | 60-237981 | 11/1985 |
| JP | 60-237982 | 11/1985 |
| JP | 62-179374 | 8/1987 |
| JP | 82-179376 | 8/1987 |
| JP | 62-198377 | 9/1987 |
| JP | 62-198378 | 9/1987 |
| JP | 62-198379 | 9/1987 |
| JP | 63-193499 | 12/1988 |
| JP | 8-266261 | 10/1996 |
| JP | 11-137232 | 5/1999 |
| JP | 2000-300237 | 10/2000 |

OTHER PUBLICATIONS

Excerpt of Monitor Report for Yaddok–kao tea (Smoking–Suppressive tea) in Japanese and English published prior to Mar. 22, 2002.

* cited by examiner

*Primary Examiner*—Dionne A. Walls
(74) *Attorney, Agent, or Firm*—Wenderoth, Lind & Ponack, L.L.P.

(57) ABSTRACT

This invention is directed to a cigarette filter containing an extract of Vernonia Cinerea (L.) Less. According to this invention, novel cigarette filter and cigarette are provided which are capable of effectively providing a desired effect in facilitating smokers' suppressing smoking or giving up smoking such as to satisfy smokers' desire to smoke and smoking habit without changing the cigarette's own flavor thereby allowing the smokers to reduce the number of cigarettes smoked easily while permitting them to keep on smoking without interruption.

2 Claims, No Drawings

CIGARETTE FILTER AND CIGARETTE

BACKGROUND OF THE INVENTION

1. Field of the Invention

The present invention relates to a cigarette filter containing an extract of Vernonia Cinerea (L.) Less and a cigarette attached with the cigarette filter.

2. Description of the Related Art

A great number of smokers desire to give up smoking. Major reasons for this desire include: (1) tobacco is generally known to be harmful to health and, particularly, known to have carcinogenicity causing lung cancer and like cancers; (2) smoke (secondhand smoke) or smell of tobacco makes people around the smoker unpleasant, and what is more, it is said to be carcinogenic to such people.

Many such smokers desiring to give up smoking have taken some action to give up smoking more than once. However, there is a less number of smokers who have successfully given up smoking in spite of considerable intention and effort to give up their favorite in the life habit. Some of those who are unsuccessful in giving up smoking lose confidence or become or revert to heavy smokers far from reducing the number of cigarettes smoked. For this reason, smokers buy cigarettes including the phrase "mild" or "light" against their will and keep on smoking while justifying their smoking claiming that such cigarettes contain reduced amount of nicotine or tar. Though there are some smokers who try to give up smoking by the use of nicotine-containing chewing gum or chewing tobacco, it does not mean that they are relieved from addiction to nicotine and, hence, they are likely to resume smoking at any time. Further, such smokers experience such frustration as derived from "inhibition to light a cigarette", "deprivation of the pleasure of smoking due to giving up smoking", or the like during the stop smoking period, and, hence, feel additional stresses. This is because problems related to smoking include not only nicotinism. Any one of smokers, whether or not they desire to give up smoking, may unintentionally (a) want to put his or her finger about his or her mouth; (b) want to bring something into contact with his or her lips; (c) want to light a cigarette; (d) want to take breath and enjoy smoking while appreciating smoke; and after all, (e) yield to nicotinism. Smokers protect themselves from stresses by following these steps (a) to (e).

On the other hand, there are a number of smokers who are particular to their own tastes and are sensitive to scents and tastes of cigarettes of different brands. Herb-mixed cigarette imitations or cigarettes flavored with the scent of a fruit or the like for helping smokers' suppressing smoking or giving up smoking, which are called "health-oriented cigarettes" or "cigarettes for controlling smoking", do not meet the taste of such a smoker and hence the smoker may feel such products "not tasty". For this reason, it is a reality that such a smoker resumes smoking his or her favorite cigarette eventually.

Alternatively, there are some smokers who positively enjoy smoking and intentionally avoid giving up smoking notwithstanding the aforementioned facts (1) and (2). For this reason, tobacco companies may try to improve the scent and taste of cigarettes, but may never try to produce and sell products with degraded scent and taste for supporting smokers' giving up smoking.

Accordingly, it has been earnestly desired that a novel cigarette filter and a cigarette be provided which enable smokers to suppress smoking or give up smoking for health to realize their desire efficiently with no stress exerted thereto without the likelihood that nonsmokers feel smoke or scent of the cigarette unpleasant. Heretofore, however, almost absolutely no study has been made from such a point of view.

The present invention has been made in view of the foregoing circumstances. Accordingly, it is an object of the present invention to provide a novel cigarette filter which is capable of providing a desired effect of facilitating smokers' suppressing smoking or giving up smoking while sufficiently satisfying the desire of such smokers to smoke and meeting their smoking habit without changing the cigarette's own flavor thereby allowing the smokers to readily reduce the number of cigarettes smoked without the necessity of interrupting smoking, and a novel cigarette provided with such a filter.

SUMMARY OF THE INVENTION

According to an aspect of the present invention, there is provided a cigarette filter containing an extract of Vernonia Cinerea (L.) Less.

According to another aspect of the present invention, there is also provided a cigarette comprising the cigarette filter as recited above.

DETAILED DESCRIPTION OF THE PREFERRED EMBODIMENTS

The present invention will now be described in detail.

In order to provide a cigarette for allowing smokers to suppress smoking or give up smoking which satisfies all the aforementioned conditions, the inventors of the present invention have made research for and study of various substances which may allow smokers to suppress smoking or give up smoking in order to develop a cigarette filter containing some substance which facilitates smokers' suppressing smoking or giving up smoking thereby to provide an effect of allowing such smokers to suppress smoking or give up smoking without degrading the scent or taste of a cigarette so that the cigarette satisfies the taste of any smoker, whether he or she desires to give up smoking or not. The inventors have discovered the fact that among such substances, an extract of Vernonia Cinerea (L.) Less, in particular, satisfies the foregoing conditions, and have made further study thereof. As a result, they have reached a discovery that the use of a cigarette filter containing the Vernonia Cinerea Less extract can provide desired effects, and have completed the present invention.

Vernonia Cinerea (L.) Less is one of native Thai herbs, belongs to the chrysanthemum family, and is called "little ironweed". Heretofore, Vernonia Cinerea Less has been utilized as a food or drink by being wholly boiled with hot water for eating or by being wholly dried to prepare a tea (Vernonia Cinerea Less tea) for drinking. Vernonia Cinerea Less has also been utilized for medical purposes because it is expected to be efficacious in treating skin injuries of diabetics, in lowering a blood sugar value, or in like medical treatments.

Further, the Vernonia Cinerea Less tea is known to exhibit an action of facilitating smokers' giving up smoking. For example, it has been reported that more than about 80% of smokers who had drunk one to three cups of Vernonia Cinerea Less tea a day for about two to threeconsecutive weeks could reduce the number of cigarettes smoked to about a half, and could be relieved of nerve-racking state.

In such a case, however, a smoker has to drink the Vernonia Cinerea Less tea separately from smoking. Since each person has his or her own taste concerning drinks such as coffee and tea, smokers, if forced to take another kind of drink (Vernonia Cinerea Less tea) in addition to such drinks for the purpose of only giving up smoking, become subject to another stress. Particularly, smokers often enjoy smoking together with a drink and, in such a case the Vernonia Cinerea Less tea does not necessarily meet the taste of such smokers. Further, the stress becomes more considerably heavy because such smokers may take actions full of contradiction: that is, enjoying smoking at the same time with drinking of the Vernonia Cinerea Less tea for giving up smoking.

In view of the above, the inventors of the present invention changed the way of thinking and conceived the idea of applying Vernonia Cinerea Less to a cigarette instead of drinking Vernonia Cinerea Less as a tea. They thought that the application of Vernonia Cinerea Less to a cigarette would not force smokers to drink tea prepared for a specific purpose and hence would provide a desired effect of allowing smokers to suppress smoking or give up smoking readily while enjoying smoking as usual (that is, without any change of their life habit). Heretofore, such a change in the way of thinking has not been known at all and, moreover, it has been far from being predictable that the application of Vernonia Cinerea Less to a cigarette can completely fulfill the object of the present invention as will be described later.

More specifically, though the Vernonia Cinerea Less tea has recently been recognized to have the effect of facilitating smokers' giving up smoking, the inventors of the present invention found the use of Vernonia Cinerea Less as a tea inappropriate as means for facilitating smokers' giving up smoking and hence unacceptable to the public for the following reasons. As stated several times previously, smokers are particular about the scent and taste of cigarettes. Smokers have their own preference for the taste of coffee or tea to drink together with smoking, and their preferred taste may never be the taste of the Vernonia Cinerea Less tea. Moreover, many people will not dare to buy any other tea than the tea of their daily use or to brew Vernonia Cinerea Less for extraction. Accordingly, it is difficult for such smokers to go so far as to change their daily life style in order to keep on drinking the Vernonia Cinerea Less tea.

The present invention has been made from the viewpoints stated above and provides a breakthrough capable of overcoming the aforementioned problems. Technical features of the present invention reside in the discoveries that: Vernonia Cinerea Less, which had so far not been applied to a cigarette and only had been used as a tea to drink, was applied to a cigarette filter with the result that substantially the same effect of facilitating smokers'suppresing smoking or giving up smoking as the effect resulted from the case where smokers kept on drinking the Vernonia Cinerea Less tea every day according to an instruction; and a cigarette according to the present invention does not lose its scent and degrade its flavor unlike a conventional flavoring agent and exhibited such effects as an improvement in the halitosis of a smoker, which cannot possibly be provided by any conventional cigarette proposed for facilitating smokers suppressing smoking or giving up smoking.

The reason why Vernonia Cinerea Less is added to a cigarette filter according to the present invention is that an experiment in which Vernonia Cinerea Less was mixed with tobacco provided no desired effect. Specifically, according to a smoking experiment with use of tobacco mixed with Vernonia Cinerea Less, all the testees (10 of 10 testees) judged such tobacco "not tasty" due to a change in tobacco's own flavor, and there was no effect of facilitating smokers' giving up smoking(10 of 10 testees showed no desire of stopping smoking). For this reason, any urinary cotinine determination was not conducted. The present invention has been made based on such fundamental experiments. Taking all the results of a series of such experiments into consideration, the inventors found that the constitution that Vernonia Cinerea Less is added to a cigarette filter was most useful and hence specified this constitution.

What smokers who cannot give up smoking in spite of their desire to give up smoking can make easily every day without any specific effort is to keep on smoking cigarettes of the same flavor as the cigarette they have been smoking as ever. Compulsory new efforts other than the effort stated above impose a heavy mental stress on such smokers and hence result in a failure in most cases. This is the weakness of human beings. The inventors of the present invention believe that the present invention provides a stress-free cigarette for the smokers who cannot give up smoking in spite of their desire to give up smoking.

Hitherto, there have been provided cigarettes with a catch phrase that the cigarettes allow smokers to suppress smoking, eventually give up smoking while meeting the smokers' smoking habit and desire for smoking. For example, there has been proposed a cigarette with a filter containing a flavoring agent expected to deter smokers from being motivated to smoke or to suppress desire for smoking (hereinafter, such a filter will be sometimes referred to as "smoking-suppressive filter") as disclosed in Japanese Patent Laid-Open Gazette No. SHO 60-23781 for example.

Such smoking-suppressive filters so far proposed have been produced based on an idea to urge smokers to suppress smoking or give up smoking eventually while allowing the smokers to keep on enjoying smoking. However, the inclusion of an odd flavoring agent or the like impairs the cigarette's own flavor and, hence, the pleasure of smoking itself is deprived of the smoker. In fact, smokers who had begun using such a filter with an intention to give up smoking gave up using such smoking-suppressive filter and eventually resumed smoking a cigarette with a generally available filter as ever in order to secure the pleasure of smoking, which has been deprived of during the period of using such a smoking-suppressive filter. Thus, such smoking-suppressive filters involve a problem that their purpose of suppressing smoking cannot be attained eventually.

In contrast, an inventive cigarette filter containing an extract of Vernonia Cinerea Less according to an embodiment of the present invention is a surprising breakthrough filter because it can provide a desired effect in facilitating smokers' suppressing smoking or giving up smoking without impairing the cigarette's own flavor while allowing the smokers to continue their smoking style as usual.

Such a Vernonia Cinerea Less extract is prepared by the following method.

In brief, the preparation method includes a hot water extraction process using water as a major extraction solvent and the whole body of Vernonia Cinerea Less.

Vernonia Cinerea Less is a native Thai herb as described earlier, but its cultivation region is not necessarily limited to Thailand. It is possible to use Vernonia Cinerea Less grown in a subtropical region that is similar to Thailand in environmental conditions for cultivation such as weather and climate (Cambodia, Myanmar, Laos, Vietnam, Indonesia, China, India, or the like). Also, Vernonia Cinerea Less grown by a typical growing method can be used without any particular limitation on cultivation conditions and the like.

As well, it is possible to use a variant, F1 hybrid, gene manipulated variant and cultivar of Vernonia Cinerea Less.

Although it is recommended that the whole body of Vernonia Cinerea Less be used, a part of the body such as leaf, stem or flower may be used. It is also recommended that Vernonia Cinerea Less be cut to an appropriate size and optionally dried before use for easy extraction.

The extraction solvent may be any such solvent comprising water as a major component. Though extraction with water only is possible, extraction may be performed using water containing at least one organic solvent (for example, a typical organic solvent free from exerting an adverse affect on reaction such as lower alcohols, e.g. methanol or ethanol, or acetones) in such a small amount as far as such an organic solvent does not adversely affect the effects provided by the present invention.

It is recommended that the extraction concentration of Vernonia Cinerea Less be adjusted to fall within a range between 1 g and 15 g of Vernonia Cinerea Less per 100 mL of the extraction solvent, preferably not less than 3 g (more preferably not less than 6 g) and not more than 12 g of Vernonia Cinerea Less per 100 mL of the extraction solvent. This extraction concentration is adjusted to a value higher than the concentration of a typical Vernonia Cinerea Less tea (1.5 g Vernonia Cinerea Less/150 mL water). This is because the extraction concentration thus adjusted will provide an extract capable of exhibiting desired effects.

Though the extraction time varies depending upon the amounts of the solvent used and Vernonia Cinerea Less, it is generally recommended that extraction be performed for a time period from the beginning of boiling of 100 mL of the extraction solvent in which Vernonia Cinerea Less has been put until the total amount is reduced to about ½ (about 30 to about 40 minutes). Thus, an extract adequate to exhibit desired effects can be obtained.

In extraction, it is possible to employ a process including: boiling the extraction solvent first; and then putting Vernonia Cinerea Less thereinto, or a process including: putting Vernonia Cinerea Less into the extraction solvent; and then boiling the extraction solvent. The former process was confirmed to provide an extract exhibiting a superior effect through experiments.

Vernonia Cinerea Less is thus subjected to hot-water extraction, and then the resulting extract is left to room temperature after optional filtration to give a desired Vernonia Cinerea Less extract. It should be noted that a cold-water extraction process, high-pressure extraction process or a like process may be employed.

The Vernonia Cinerea Less extract obtained by the aforementioned method is added to a filter by the following method. In order for the inventive cigarette filter according to the embodiment of the present invention to exhibit desired effects, the Vernonia Cinerea Less extract needs to wet out the entire cross section of the filter. It is therefore recommended that the amount of the Vernonia Cinerea Less extract to be added to one filter is adjusted to a value from about 0.05 to about 0.5 mL, preferably from about 0.1 to 0.2 mL so that the cross section of the filter becomes entirely wetted out with the extract, though the amount of the Vernonia Cinerea Less extract may vary depending upon the size, material or the like of the filter to be used.

The inventive filter containing the Vernonia Cinerea Less extract according to the embodiment of the present invention may be applied to a commercially available filter-tip cigarette or a cigarette filter or used under instructions from a doctor or the like for individual patients. In the latter case, it is recommended that the dry content concentration of the Vernonia Cinerea Less extract and/or the amount of the Vernonia Cinerea Less extract to be added to a filter be adjusted appropriately in view of the conditions of each smoker (the kind of a cigarette to be used, smoking amount, smoking experience, age, sex, condition of health, degree of a desire to give up smoking, and the like) and the like, because the effect of facilitating smokers' suppressing smoking or giving up smoking is enhanced and, a desired effect can be obtained in a short period by increasing the dry content concentration of the Vernonia Cinerea Less extract and/or the amount of the Vernonia Cinerea Less extract to be added to a filter. Of course, it is possible to increase or decrease the dry content concentration of the Vernonia Cinerea Less extract and/or the amount of the Vernonia Cinerea Less extract to be added to a filter depending upon the development after smoking. Specifically, it is recommended that the number of cigarettes smoked/the quantity of urinary cotinine be checked periodically and that the amount of the Vernonia Cinerea Less extract to be used be increased if a desired effect of facilitating smoker's suppressing smoking or giving up smoking is unobtainable in an appropriate period. Thus, the present invention has an advantage that a most suitable smoking control schedule for obtaining desired effects can be easily designed or modified in accordance with the condition of a smoker at an appropriate occasion. It is to be noted that urinary cotinine is a metabolic product of nicotine and that the quantity of urinary cotinine was substantiated as one of scientific/medical nicotine intake parameters.

In the case where the cigarette filter according to the embodiment of the present invention is used for general smokers, the cigarette filter may be prepared as a filter product having several grades determined taking the former case into consideration or as a filter product containing a mean effective amount of the Vernonia Cinerea Less extract at manufacturer's discretion. It is obvious from the results of the experiment to be described later that the cigarette filter according to the embodiment of the present invention exhibits a desired effect of facilitating smoker's suppressing smoking or giving up smoking for smokers having a strong desire to suppress smoking or give up smoking thereby decreasing urinary cotinine to make each smoker more healthy. For smokers having no desire to suppress smoking or give up smoking, on the other hand, the cigarette filter according to the embodiment of the present invention allows such smokers to keep on smoking at the same level as ever without evoking desire to suppress smoking or give up smoking from the smokers because it does not change the scent and taste of a cigarette. Thus, the cigarette filter according to the embodiment of the present invention is applicable to commercially-available cigarettes in general irrespective of whether or not or to what extent smokers desire to suppress smoking or give up smoking and is very useful as it does not deprive the pleasure of smoking of the smokers. There is no particular limitation on the shape of a filter used in the present invention, and the present invention is applicable to the filters of generally available filter-tipped cigarettes and filters prepared for exclusive use with cigarettes.

The present invention is capable of exhibiting a superior effect of facilitating smokers' suppressing smoking or giving up smoking for smokers having an intention to give up smoking. Specifically, the present invention is very useful because it allows smokers who want smoking by lighting a cigarette to break away with their mental addiction while meeting their desire for smoking and their smoking habit without changing the cigarette's own flavor and because it provides desired effects without giving any stress to the smokers. Particularly, as will be described in Example, it was proved that smokers who smoked an inventive cigarette according to the embodiment of the present invention could get rid of the "bad smell inherent to smoking". As compared particularly with the aforementioned flavoring-agent-containing cigarette which is actually hated by nonsmokers because of the bad smell inherent thereto, the present invention is capable of resolving all such problems and hence is very useful.

Although it is unclear in terms of strictness why the addition of the Vernonia Cinerea Less extract to an inventive filter according to the embodiment of the present invention provides such an excellent effect of facilitating smokers' suppressing smoking or giving up smoking, it is conceivable that since the components of the Vernonia Cinerea Less extract are directly absorbed by the nosal mucosa and lungs of a smoker together with cigarette smoke without decomposition at the stomach or intestine of the smoker which occurs if they are drunk, such direct absorption requires a much smaller amount of the Vernonia Cinerea Less extract to allow a remarkably superior effect to result than required in the case where the Vernonia Cinerea Less extract is used for drink. Further, it is conceivable that such a superior effect results from the Vernonia Cinerea Less extract aspirated many times a day unlike the case of the Vernonia Cinerea Less tea drunk a few times a day. Various effects of the present invention proved in Example to be described later may be un-explicable effects that may not be elucidated by the present level of science and technology. Further, the inventors of the present invention consider that the present invention becomes applicable not only for use in facilitating smoker's suppressing smoking or giving up smoking but also to treatments for patients mentally addicted to narcotics such as marijuana, alcoholics and the like in the future.

EXAMPLE

Hereinafter, the present invention will be described in detail by way of an example, which should not be construed to limit the technical scope of the present invention including all changes and modifications made in the example without departing from the context of the description of the present invention.

In the following experiment 49 testees who did not give up smoking at the time of the experiment were requested to attend to the experiment without being told the purpose of the experiment.

Invention-Applied Group

Of these testees, 24 testees having smoking experiences of from 4 to 53 years were allowed to select their respective favorite cigarettes that were of the same brands as cigarettes they had usually smoked so far. The testees were allowed smoke their respective favorite cigarettes with filters thereof wetted out with an extract of Vernonia Cinerea Less for two consecutive months. The number of cigarettes smoked by each testee and the quantity of urinary cotinine of each testee were measured with time according to the following method to examine the effect of the cigarette according to the present invention in facilitating smokers'suppressing smoking or giving up smoking.

Cigarettes used in this example were prepared through the following process.

First, chipped Vernonia Cinerea Less in an amount of 30 g was put into 1000 mL of water and heated and boiled until the amount of water reduced to about ½, followed by filtration to give the Vernonia Cinerea Less extract. The filter portions of cigarettes usually smoked by respective testees were wet out with the extract thus obtained by adding two droplets (about 0.1 mL) of the extract dropwise to the filter portion of each cigarette and then allowed to dry naturally to give cigarettes according to the present invention. Table 1 shows all the brands of cigarettes used in this example and the tar content and the nicotine content of each of the cigarettes.

The testees were allowed to smoke respective cigarettes thus prepared for one consecutive month and then to smoke respective cigarettes prepared by a different process than the foregoing process from the beginning of the second month. Specifically, the cigarettes used in the second month were prepared by adding three droplets of a Vernonia Cinerea Less extract having a Vernonia Cinerea Less concentration twice as high as the concentration of the former Vernonia Cinerea Less extract dropwise to the filter portion of each cigarette and allowing the filter portion to dry naturally, the higher concentration extract having been prepared by subjecting 60 g of tipped Vernonia Cinerea Less in 1000 mL of water to hot water extraction.

Control Group

For comparison, 24 testees having smoking experiences of 1 to 56 years were allowed to smoke their respective favorite cigarettes having filter portions wet out with oolong tea instead of the Vernonia Cinerea Less extract without knowing the purpose of the experiment. In the same manner as above, the number of cigarettes smoked by each testee and the quantity of urinary cotinine of each testee were measured with time.

Reference Group

For reference, one testee (No. 25 in Table 2 to be shown later) was allowed to smoke his usually smoking cigarette as ever and, at the same time, to drink the Vernonia Cinerea Less tea every day. In the same manner as above, the number of cigarettes smoked by the testee and the quantity of urinary cotinine of the testee were measured with time. Specifically, the testee was allowed to drink the Vernonia Cinerea Less tea, which was obtained by putting a tea bag containing 1.5 g of Vernonia Cinerea Less into 150 mL of hot water, once or twice a day for two months every day. The Vernonia Cinerea Less tea used here as well as the chipped Vernonia Cinerea Less used for cigarette filters was a product of BELNOKI. CO., LTD. (Bangkok Thailand).

Method of Measuring the Number of Cigarettes Smoked

The number of cigarettes smoked per day by each testee was measured before (the day before) the beginning of the experiment, after lapse of one month from the beginning of the experiment, and after lapse of two months from the beginning of the experiment.

Method of Measuring the Quantity of Urinary Cotinine

The first urine of each testee was collected early in the morning before (the day before) the beginning of the experiment, after lapse of one month from the beginning of the experiment, and after lapse of two months from the beginning of the experiment. The quantity of urinary cotinine of the urine thus collected was measured by gas chromatography using an alkali flame ionization detector (AFDI) (Hitachi 073 GC FTD), which is useful in measuring a trace cotinine quantity.

The results of these measurements are both shown in Tables 2 and 3. It should be noted that since there were observed variations in the quantity of cotinine and the number of cigarettes smoked among the testees, the effect of facilitating smokers' suppressing smoking or giving upsmoking was objectively evaluated according to the following criteria.

○ . . . $\{(a-b)/b\}\times100(\%)\geqq10$

X . . . $\{(a-b)/b\}\times100(\%)<10$ wherein a is the quantity of cotinine or the number of cigarettes smoked measured before the beginning of the experiment, and b is the quantity of cotinine or the number of cigarettes smoked measured after lapse of two months from the beginning of the experiment.

That is, the symbol "○" indicates a case objectively evaluated to have exhibited the effect of facilitating smoker's suppressing smoking or giving up smoking since there was a reduce of 10% or more in the quantity of cotinine or the number of cigarettes smoked. In Tables 2 and 3, only the testees evaluated "○" as to both the quantity of cotinine and the number of cigarettes smoked were each evaluated "○" as a total evaluation.

TABLE 1

| | Kinds of Cigarettes | | |
|---|---|---|---|
| No. | Brands | Tar (mg) | Nicotine (mg) |
| A | Lark (Red Package) | 12 | 0.9 |
| B | Philip Morris | 5 | 0.4 |
| C | Philip Morris Extra Light 100 | 3 | 0.3 |
| D | Cabin Mild Box | 8 | 0.7 |
| E | Cabin Ultra Mild | 2 | 0.2 |
| F | Mild Seven | 11 | 0.9 |

TABLE 1-continued

| | Kinds of Cigarettes | | |
|---|---|---|---|
| No. | Brands | Tar (mg) | Nicotine (mg) |
| G | Mild Seven FK | 11 | 0 . 8 |
| H | Mild Seven Long | 1 | 0.1 |
| I | Mild Seven Light | 8 | 0.7 |
| J | Mild Seven Super Light | 6 | 0.5 |
| K | Mild Seven Extra Light | 3 | 0.3 |
| L | Caster Mild | 6 | 0.5 |
| M | Caster Super Mild | 3 | 0.3 |
| N | Parliament Mild | 1 | 0.1 |
| O | Parliament DX Light | 8 | 0.7 |
| P | Seven Stars | 15 | 1.3 |
| Q | Marlboro Red | 12 | 1.0 |
| R | Salem Pianissimo | 3 | 0.3 |
| S | Long Peace | 21 | 2.1 |
| T | Lark Mild | 9 | 0.7 |
| U | Frontier | 1 | 0.1 |
| V | KENT 1 | 1 | 0.1 |
| W | NEXT 1 mg | 1 | 0.1 |
| X | ALFA | 1 | 0.1 |
| Y | Koiki (10 g package) | — | — |

TABLE 2

| | | | | | Cotinine Concentration (ng/ml) | | | Number of Cigarettes Smoked | | | | Objective Evaluation | | |
|---|---|---|---|---|---|---|---|---|---|---|---|---|---|---|
| No. | Age | Sex | S.E. | K.C. | Before the beginning of experiment | After lapse of one month | After lapse of two months | Before the beginning of experiment | After lapse of one month | After lapse of two months | I.G.S. | N.C.S. | Cotinine | T.E. |
| 1 | 36 | M | 21 | A | 1000 | 880 | 890 | 20 | 18 | 17 | Yes | ○ | ○ | ○ |
| 2 | 33 | F | 14 | A | ≧2000 | ≧2000 | ≧2000 | 60 | 30 | 35 | No | ○ | x | x |
| 3 | 38 | F | 16 | W | 1600 | 1600 | ≧2000 | 60 | 60 | 55 | Yes | x | x | x |
| 4 | 57 | M | 39 | B | ≧2000 | 1800 | ≧2000 | 40 | 25 | 15 | Yes | ○ | x | x |
| 5 | 54 | F | 31 | B | 480 | 620 | 510 | 50 | 50 | 50 | No | x | x | x |
| 6 | 43 | M | 26 | E | 1400 | ≧2000 | ≧2000 | 80 | 80 | 40 | No | ○ | x | x |
| 7 | 41 | M | 23 | V | ≧2000 | — | 1500 | 20 | 30 | 15 | Yes | ○ | ○ | ○ |
| 8 | 23 | F | 4 | R | ≧2000 | ≧2000 | 1100 | 30 | 30 | 20 | Yes | ○ | ○ | ○ |
| 9 | 41 | M | 23 | J | 1200 | 530 | 340 | 20 | 20 | 12 | Yes | ○ | ○ | ○ |
| 10 | 61 | M | 42 | L | 1200 | 1100 | 470 | 9 | 10 | 5 | Yes | ○ | ○ | ○ |
| 11 | 57 | M | 39 | J | 1400 | ≧2000 | 400 | 20 | 30 | 15 | Yes | ○ | ○ | ○ |
| 12 | 48 | M | 29 | M | ≧2000 | — | 310 | 30 | 33 | 15 | Yes | ○ | ○ | ○ |
| 13 | 62 | M | 44 | C | 550 | lower than sensitivity | lower than sensitivity | 15 | 10 | 5 | Yes | ○ | ○ | ○ |
| 14 | 43 | M | 23 | K | ≧2000 | — | 640 | 30 | 20 | 15 | Yes | ○ | ○ | ○ |
| 15 | 54 | M | 40 | K | ≧2000 | ≧2000 | 840 | 80 | 40 | 40 | Yes | ○ | ○ | ○ |
| 16 | 42 | M | 27 | J | ≧2000 | — | 790 | 30 | 30 | 15 | Yes | ○ | ○ | ○ |
| 17 | 42 | M | 24 | J | ≧2000 | ≧2000 | ≧2000 | 30 | 30 | 30 | No | x | x | x |
| 18 | 38 | M | 20 | R | ≧2000 | ≧2000 | 1000 | 30 | 30 | 20 | Yes | ○ | ○ | ○ |
| 19 | 40 | M | 20 | P | 1500 | 1300 | 1200 | 20 | 20 | 20 | No | x | ○ | x |
| 20 | 54 | M | 34 | L | 1600 | ≧2000 | ≧2000 | 20 | 20 | 20 | No | x | x | x |
| 21 | 50 | M | 25 | D | 510 | 63 | lower than sensitivity | 20 | 20 | 0 | Yes | ○ | ○ | ○ |

TABLE 2-continued

| No. | Age | Sex | S.E. | K.C. | Cotinine Concentration (ng/ml) Before the beginning of experiment | After lapse of one month | After lapse of two months | Number of Cigarettes Smoked Before the beginning of experiment | After lapse of one month | After lapse of two months | I.G.S. | Objective Evaluation N.C.S. | Cotinine | T.E. |
|---|---|---|---|---|---|---|---|---|---|---|---|---|---|---|
| 22 | 73 | M | 53 | S | 400 | 450 | 300 | 20 | 15 | 15 | Yes | ○ | ○ | ○ |
| 23 | 45 | M | 27 | F | ≧2000 | ≧2000 | 870 | 40 | 40 | 30 | Yes | ○ | ○ | ○ |
| 24 | 38 | M | 18 | V | ≧2000 | 1400 | ≧2000 | 30 | 30 | 30 | No | x | x | x |
| 25 | 60 | M | 40 | V | 1000 | 730 | 590 | 25 | 18 | 15 | Yes | ○ | ○ | ○ |

Note:

the symbol "—" in this Table represents a case where measurement was not performed.

M. means Male

F. means Female

S.E. means Smoking Experience

K.C. means Kinds of Cigarettes

I.G.S. means Intention to give up smoking

N.C.S. means Number of Cigarettes smoked

○ indicates number of cigarettes decreased after lapse of certain period, x indicates number of cigarettes did not decrease or remained the same after lapse of certain period.

T.E. means Total Evaluation

TABLE 3

| No. | Age | Sex | S.E. | K.C. | Cotinine Concentration (ng/ml) Before the beginning of experiment | After lapse of one month | After lapse of two months | Number of Cigarettes Smoked Before the beginning of experiment | After lapse of one month | After lapse of two months | I.G.S. | Objective Evaluation N.C.S. | Cotinine | T.E. |
|---|---|---|---|---|---|---|---|---|---|---|---|---|---|---|
| 26 | 33 | M | 19 | T | 410 | 360 | 520 | 20 | 35 | 30 | No | x | x | x |
| 27 | 52 | M | 16 | F | lower than sensitivity | lower than sensitivity | lower than sensitivity | 20 | 20 | 20 | Yes | x | Δ | x |
| 28 | 28 | M | 10 | P | ≧2000 | 1400 | 1900 | 12 | 14 | 15 | Yes | x | x | x |
| 29 | 59 | M | 41 | O | 1300 | — | 1300 | 40 | 40 | 40 | No | x | x | x |
| 30 | 65 | M | 46 | U | ≧2000 | ≧2000 | ≧2000 | 40 | 40 | 50 | Yes | x | x | x |
| 31 | 63 | F | 38 | F | 380 | 830 | ≧2000 | 25 | 17 | 18 | Yes | ○ | x | x |
| 32 | 44 | M | 28 | G | ≧2000 | 1800 | 980 | 40 | 40 | 40 | Yes | x | ○ | x |
| 33 | 34 | M | 16 | A | ≧2000 | ≧2000 | ≧2000 | 20 | 20 | 20 | No | x | x | x |
| 34 | 53 | F | 27 | W | 1300 | 740 | 1200 | 15 | 14 | 20 | Yes | x | x | x |
| 35 | 54 | M | 39 | S | 1700 | — | ≧2000 | 40 | 40 | 40 | No | x | x | x |
| 36 | 47 | M | 29 | J | 250 | 210 | 300 | 40 | 40 | 40 | Yes | x | x | x |
| 37 | 62 | F | 30 | X | 900 | 970 | 1200 | 60 | 60 | 60 | No | x | x | x |
| 38 | 61 | M | 39 | N | 890 | — | 800 | 40 | 45 | 40 | Yes | x | x | x |
| 39 | 34 | F | 1 | Q | 43 | — | lower than sensitivity | 10 | 10 | 10 | Yes | x | ○ | x |
| 40 | 61 | M | 40 | F | 1300 | — | 1500 | 10 | 10 | 10 | Yes | x | x | x |
| 41 | 76 | M | 56 | H | 140 | — | 170 | 15 | 15 | 15 | Yes | x | x | x |
| 42 | 59 | F | 40 | H | 270 | — | 750 | 15 | 15 | 17 | Yes | x | x | x |
| 43 | 31 | M | 13 | I | 1200 | 930 | 1400 | 15 | 20 | 20 | Yes | x | x | x |
| 44 | 45 | M | 26 | I | lower than sensitivity | ≧2000 | 1500 | 20 | 20 | 20 | Yes | x | x | x |
| 45 | 57 | M | 37 | F | 600 | — | 620 | 20 | 20 | 20 | Yes | x | x | x |
| 46 | 28 | M | 10 | F | 1600 | ≧2000 | 2000 | 30 | 30 | 30 | No | x | x | x |
| 47 | 41 | M | 21 | F | lower than sensitivity | | 540 | 20 | 20 | 20 | Yes | x | x | x |

TABLE 3-continued

| | | | | | Cotinine Concentration (ng/ml) | | | Number of Cigarettes Smoked | | | | Objective Evaluation | | |
|---|---|---|---|---|---|---|---|---|---|---|---|---|---|---|
| No. | Age | Sex | S.E. | K.C. | Before the beginning of experi-ment | After lapse of one month | After lapse of two months | Before the beginning of experi-ment | After lapse of one month | After lapse of two months | I.G.S. | N.C.S. | Coti-nine | T.E. |
| 48 | 48 | M | 31 | Y | ≧2000 | — | ≧2000 | 10 | 10 | 10 | No | x | x | x |
| 49 | 46 | M | 29 | F | ≧2000 | — | ≧2000 | 20 | 20 | 20 | No | x | x | x |

Note:
the symbol "—" in this Table represents a case where measurement was not performed, and the symbol "Δ" represents a case where the quantity of cotinine was lower than the measuring sensitivity and, hence, objective evaluation was impossible.
M. means Male
F. means Female
S.E. means Smoking Experience
K.C. means Kinds of Cigarettes
I.G.S. means Intention to give up smoking
N.C.S. means Number of Cigarettes smoked
○ indicates number of cigarettes decreased after lapse of certain period,
x indicates number of cigarettes did not decrease or remained the same after lapse of certain period.
T.E. means Total Evaluation Table 2 shows the results of the testees who smoked the inventive cigarettes according to the embodiment of the present invention (the invention-applied group) and the results of the testee who drank the Vernonia Cinerea Less tea (reference group); and Table 3 shows the results of the testees who smoked cigarettes added with oolong tea. From these Tables the following considerations can be given.

With respect to the invention-applied group, it is seen from Table 2 that: 18 (75%) of the 24 testees who smoked in the manner specified according to the Example of the present invention showed a reduction of 10% or more in the number of cigarettes smoked after lapse of two months from the beginning of the experiment; 16 (about 66.7%) of the 24 testees showed a reduction of 10% or more in the quantity of cotinine; and 15 (62.5%) of the 24 testees showed a reduction of 10% or more in both the number of cigarettes smoked and the quantity of cotinine. Thus, the present invention provided a very excellent effect in facilitating smokers' suppressing smoking or giving up smoking. These results were substantially the same as the result of testee No. 25 shown in Table 2 who drank Vernonia Cinerea Less tea every day as instructed.

Testee No. 21 of the invention-applied group, who had a smoking experience of 25 years, had been smoking as many as 20 cigarettes per day on the average and had not been able to give up smoking for years despite his intention to give up smoking, succeeded in completely giving up smoking before lapse of no longer than two months from the starting of smoking the inventive cigarette according to the embodiment of the present invention instead of his usually smoking conventional cigarette. After the testee stopped smoking, he never resumed smoking.

With respect to the control group, in contrast, it is seen from Table 3 that: only one (about 4.2%) of the 24 testees showed a reduction of 10% or more in the number of cigarettes smoked; only two (about 8.3%) of the 24 testees showed a reduction of 10% or more in the quantity of cotinine; and no testee showed a reduction of 10% or more in both the number of cigarettes smoked and the quantity of cotinine.

As described above, smoking the inventive cigarette according to the embodiment of the present invention provided an effect of facilitating smokers' suppressing smoking or giving up smoking in no longer than two months for not less than 60% of the testees having an intention to give up smoking from the outset. The resulting effect of facilitating smokers' suppressing smoking or giving up smoking was so excellent that one of the testees succeeded in completely giving up smoking. Further, according to the observation applied to all the testees in common, all the testees felt absolutely no unpleasantness of taste (change in taste) caused by smoking of the inventive cigarette according to the embodiment of the present invention. Thus, the present invention is very useful, as it can provide the aforementioned very excellent effect of facilitating smokers' suppressing smoking or giving up smoking without imposing any stress accompanying the efforts in suppressing smoking or giving up of smoking on smokers while allowing the smokers to continue smoking as usual.

Further, more detailed examination of this Example provided very interesting knowledge that with respect to the testees originally having no intention to suppress smoking or give up smoking, the effect of facilitating smokers' suppressing smoking or giving up smoking was not observed though they smoked the inventive cigarettes according to the embodiment of the present invention. That is, none of the seven testees of the invention-applied group showed a reduction of 10% or more in both the number of cigarettes smoked and the quantity of cotinine. From this fact, it can be confirmed that the inventive cigarette according to the embodiment of the present invention is useful only for those smokers having an intention to suppress smoking or give up smoking (those smokers who have not been able to give up smoking successfully due to the mentally addicting action to nicotine in spite of their strong desire to give up smoking) and does not have such an action as to change the smokers' intention. Thus, smoking of the inventive cigarette according to the embodiment of the present invention can provide desired effects meeting the intentions of respective smokers. That is: (1) the present invention can provide a desired effect of facilitating smokers' giving up smoking for those smokers who desire to give up smoking while meeting their smoking habit and their desire to smoke; and (2) the present invention allows those smokers who do not have the intention of giving up smoking to keep on smoking cigarettes of which flavor remains the same as the cigarettes they have been usually smoking. The cigarette of the present invention is very significant in that the smokers' freedom of choice is ensured thereby. In other words, the present invention makes cigarettes more appealing by reducing the negative side of cigarettes.

It was also found from this Example that a more excellent effect of facilitating smokers' giving up smoking resulted by increasing amount of Vernonia Cinerea Less to be added to a filter. As described earlier, in this Example the amount of Vernonia Cinerea Less used in the second month from the beginning of the experiment was larger than that used in the first month. According to the results of the experiment, at the time after lapse of one month from the beginning of the experiment, only three (15%) of 20 testees who used the Vernonia Cinerea Less containing inventive filters according to the embodiment of the present invention showed a reduction in both the number of cigarettes smoked and the quantity of urinary cotinine. The number of testees showing a reduction in both the number of cigarettes smoked and the quantity of urinary cotinine increased remarkably at the end of the second month of the experiment due to smoking of the inventive cigarettes containing an increased amount of Vernonia Cinerea Less. Thus, it was confirmed that an increase in the amount of Vernonia Cinerea Less contained in an inventive filter enhanced the effect of facilitating smokers' giving up smoking.

The inventive cigarette according to the embodiment of the present invention is not only profitable to smokers but also contributable to a solution of problems involved in tobacco companies. In the United States of America, a smoker filed a suit against a tobacco maker, complaining that it is because the tobacco company concealed the information that the plaintiff became a smoker without knowing the harm of tobacco to health and was suffering from cancer, and the plaintiff won the suit. Though the "intention to give up smoking" of the smoker became an issue at the suit, the tobacco company had no means to verify the "intention to give up smoking" and hence lost the suit. As described above, the effect of facilitating smokers' giving up smoking provided by the inventive cigarette according to the embodiment of the present invention reflects smokers' strong intention to give up smoking and yet does not affect the smokers' intention. Thus, the inventive cigarette according to the embodiment of the present invention desirably reflects the smokers' will whether or not they have the "intention to give up smoking". As a result, it is expected that tobacco companies have a lowered possibility of incurring unjustified losses in such suits. This means that tobacco companies are provided with an effective weapon that clarifies the smokers' own responsibility. By selling cigarettes which are capable of selectively facilitating smokers' suppressing smoking or giving up smoking depending on the smokers' intention to give up smoking, tobacco companies can contribute to prevention of lung cancer and will be capable of defending themselves in a suit since whether to continue smoking or to suppress smoking or give up smoking depends upon the intention of a smoker.

Further, it was reported from a large number of the families of the testees that the bad smell of cigarette died out of a room after changing to the inventive cigarette according to the embodiment of the present invention. Nonsmokers particularly hate the smell produced after smoking (the smell emitted along with smokers' breath in smoking). The present invention also allows such a disagreeable smell produced after smoking to die out and contributes to an improvement in halitosis. This is one of the problems that cannot be resolved by the conventional flavoring agent containing cigarettes and one of the major merits of the present invention.

Also, the testees reported of various effects concerning improvements in physical condition including alleviation of fatigue at rising or expedient recovery of physical strength, change of blackish gums to pink gums, reduction of phlegm or cough, dying out of disagreeable halitosis, and the like. These are some of many advantages of the present invention.

The contents of this Example were obtained as a result of careful and detailed examination of the effects on the smokers' side (scientifically proved effect of facilitating smokers' suppressing smoking or giving up smoking, effect of satisfying the taste of smokers, effects concerning improvements in physical condition, and like effects), as well as of the effects on the nonsmokers' side (effect of eliminating the disagreeable smell of smoking, and like effects). Therefore, the contents are very significant as experimental data confirming the effects of the inventive cigarette according to the embodiment of the present invention from different angles.

The inventive cigarette according to the embodiment of the present invention containing the Vernonia Cinerea Less extract in the filter thereof is very useful because: (1) for smokers having an intention to suppress smoking or give up smoking, it provides a desired effect of facilitating smokers' suppressing smoking or giving up smoking such that their desire to light a cigarette and to smoke and their smoking habit are satisfied without changing the cigarette's own flavor thereby allowing the smokers to reduce the number of cigarettes smoked easily while permitting them to keep on smoking without interruption, as well as providing excellent physical condition improving effects such as recovery from fatigue, improvement in the condition of gums, and reduction of phlegm or cough; and (2) for nonsmokers around the smokers such as their families, it provides various effects including an effect of eliminating the bad smell of cigarette produced after smoking thereby releasing the nonsmokers from suffering from such bad smell.

This application is based on Japanese patent application No. 2002-81729 filed in Japan Patent Office on Mar. 22, 2002, the contents of which are hereby incorporated by reference.

Although the present invention has been fully described by way of example, it is to be understood that various changes and modifications will be apparent to those skilled in the art. Therefore, unless otherwise such changes and modifications depart from the scope of the present invention hereinafter defined, they should be construed as being included therein.

What is claimed is:

1. A cigarette filter containing an extract of Vernonia Cinerea (L.) Less.

2. A cigarette comprising the cigarette filter as recited in claim 1.

* * * * *